US007646341B1

(12) United States Patent
Lin et al.

(10) Patent No.: US 7,646,341 B1
(45) Date of Patent: Jan. 12, 2010

(54) ULTRA-WIDEBAND (UWB) ANTENNA

(75) Inventors: Yi-Cheng Lin, Taipei (TW); Kuan-Jung Hung, Taipei (TW)

(73) Assignee: National Taiwan University, Taipei (TW)

( * ) Notice: Subject to any disclaimer, the term of this patent is extended or adjusted under 35 U.S.C. 154(b) by 0 days.

(21) Appl. No.: 11/455,541

(22) Filed: Jun. 19, 2006

(51) Int. Cl.
*H01Q 1/38* (2006.01)

(52) U.S. Cl. ..... 343/700 MS; 343/767

(58) Field of Classification Search ..... 343/700 MS, 343/702, 767, 846
See application file for complete search history.

(56) References Cited

U.S. PATENT DOCUMENTS 6,198,437 B1 * 3/2001 Watson et al. ..... 343/700 MS
2005/0156787 A1 * 7/2005 Myoung et al. ..... 343/700 MS
2005/0237251 A1 * 10/2005 Boyle et al. ..... 343/770
2005/0248488 A1 * 11/2005 Modro ..... 343/700 MS
2006/0097925 A1 * 5/2006 Lee ..... 343/700 MS
2006/0103577 A1 * 5/2006 Lee ..... 343/700 MS
2007/0080871 A1 * 4/2007 Ying ..... 343/702

* cited by examiner

*Primary Examiner*—HoangAnh T Le
(74) *Attorney, Agent, or Firm*—The Weintraub Group, P.L.C.

(57) ABSTRACT

The present invention relates to an ultra-wideband (UWB) antenna, which comprises: a rectangular aperture portion, formed from a ground plane of a printed circuit board and having an aperture; and a co-plane feeding structure, having a horizontal portion and a vertical portion, wherein the vertical portion is perpendicular to the horizontal portion, and the vertical portion is disposed in the aperture and connected with an external terminal. The ultra-wideband (UWB) antenna of the present invention can receive the wireless signal with 3.1~10.6 GHz band, and have a very compact area (13 mm×23 mm) and is easy to be mass produced. Furthermore, a parasitism element can be added into the co-plane feeding structure, so as to reject the in-band interferences from the existing systems like 5~6 GHz signals of wireless LAN.

15 Claims, 12 Drawing Sheets

ULTRA-WIDEBAND (UWB) ANTENNA

FIELD OF THE INVENTION

The present invention relates to an ultra-wideband (UWB) antenna and, in particular, to an ultra-wideband (UWB) antenna which is compact, can reject the 5~6 GHz signal, and is easy to be manufactured.

BACKGROUND OF THE INVENTION

The development of ultra-wideband (UWB) technology signals the advent of the incorporation of wireless technology with high-speed transmission. Ultra-wideband (UWB) technology provides enough bandwidth for a number of applications to utilize high-speed wireless transmissions over a relatively short distance. Some examples of these applications include digital media contents, high definition television images, 3 D video, and wireless internet gaming.

Antenna design is crucial for ultra-wideband technologies. There are many important design considerations, such as size, radiation pattern stability, band rejection, and so forth. Existing antenna designs for ultra-wideband technologies suffer from setbacks such as three-dimensional structure or large size. The size of these antennae adversely affects the commercialization of the previously known devices.

In FIG. 1, "NUMERICAL AND EXPERIMENTAL STUDY OF A RETANGULAR SLOT ANTENNA FOR UWB COMMUNICATIONS" published in MICROWAVE AND OPTICAL TECHNOLOGY LETTERS (disclosed on Aug. 20, 2005) presented an ultra-wideband (UWB) structure disposed on the ground plane of a printed circuit board (PCB), having a microstrip with a fork portion. The fork portion of the microstrip is formed on the back of the PCB with an aperture of 32 mm×21 mm and thus a large double-side PCB is required. The cost is high and the rejection of 802.11a RF signal in the 5-6 GHz band cannot be performed.

In FIG. 2, "Ultrawide-band Coplanar Waveguide-Fed Rectangular Slot Antenna" published in IEEE ANTENNA AND WIRELESS PROPAGATION LETTERS (disclosed in 2004) presented an ultra-wideband (UWB) structure disposed on the ground plane of a PCB, having a microstrip with a fork portion. The aperture is of 32.2 mm×21.1 mm and thus a large single-side PCB is required. The cost is high and the rejection of 802.11a RF signal in the 5-6 GHz band cannot be performed.

In FIG. 3, "COMPACT PRINTED ULTRA-WIDEBABD SLOT ANTENNA WITH A BAND-NOTCHED OPERATION" published in MICROWAVE AND OPTICAL TECHNOLOGY LETTERS (disclosed on Aug. 20, 2005) presented an ultra-wideband (UWB) structure disposed on the ground plane of a printed circuit board, comprising a U-shaped aperture, a first slot, and a second slot. However, a structure with the U-shaped aperture, the first slot, and the second slot is complicated and thus difficult for mass production.

Consequently, it is necessary to design a new ultra-wideband (UWB) antenna to overcome the shortcomings described above.

SUMMARY OF THE INVENTION

An object of the present invention is to provide an ultra-wideband (UWB) antenna which is characterized by its compactness, stable radiation pattern, and ability to reject the 5~6 GHz signals.

Another object of the present invention is to provide an ultra-wideband (UWB) antenna which is formed on a single-sided PCB or bendable super-thin substrate, easily integrated with the radio frequency (RF) circuit, and able to greatly reduce complexity of production and its cost.

In order to achieve the objects described above, the present invention provides an ultra-wideband (UWB) antenna comprising: a rectangular aperture portion, formed from a ground plane of a printed circuit board and having an aperture; and a co-plane feeding structure, having a horizontal portion and a vertical portion, wherein the horizontal portion is perpendicular to the vertical portion, and the vertical portion is disposed in the aperture and connected with an external terminal.

Compared with conventional prior art, the ultra-wideband (UWB) antenna according to present invention can provide the following advantages: (1) it can greatly reduce the area of the printed circuit board but do not affect its performance; (2) it can be easily extended to an antenna with the band-rejection function, but the original design of the antenna needs not to be changed; and (3) its co-plane feeding structure is simple in geometry and the parameters of the ultra-wideband (UWB) antenna can be adjusted by adjusting the length and width of the horizontal portion or the space between the lower edge of the horizontal portion of the co-plane feeding structure and the inner circumference of the rectangular aperture portion.

BRIEF DESCRIPTION OF THE DRAWINGS

The present invention can be more fully understood by reference to the following description and accompanying drawings, in which:

FIG. 5(*d*) schematically illustrates the simulated and measured return loss of an ultra-wideband (UWB) antenna according to the present invention;

DETAILED DESCRIPTION OF THE INVENTION

Figure 4:
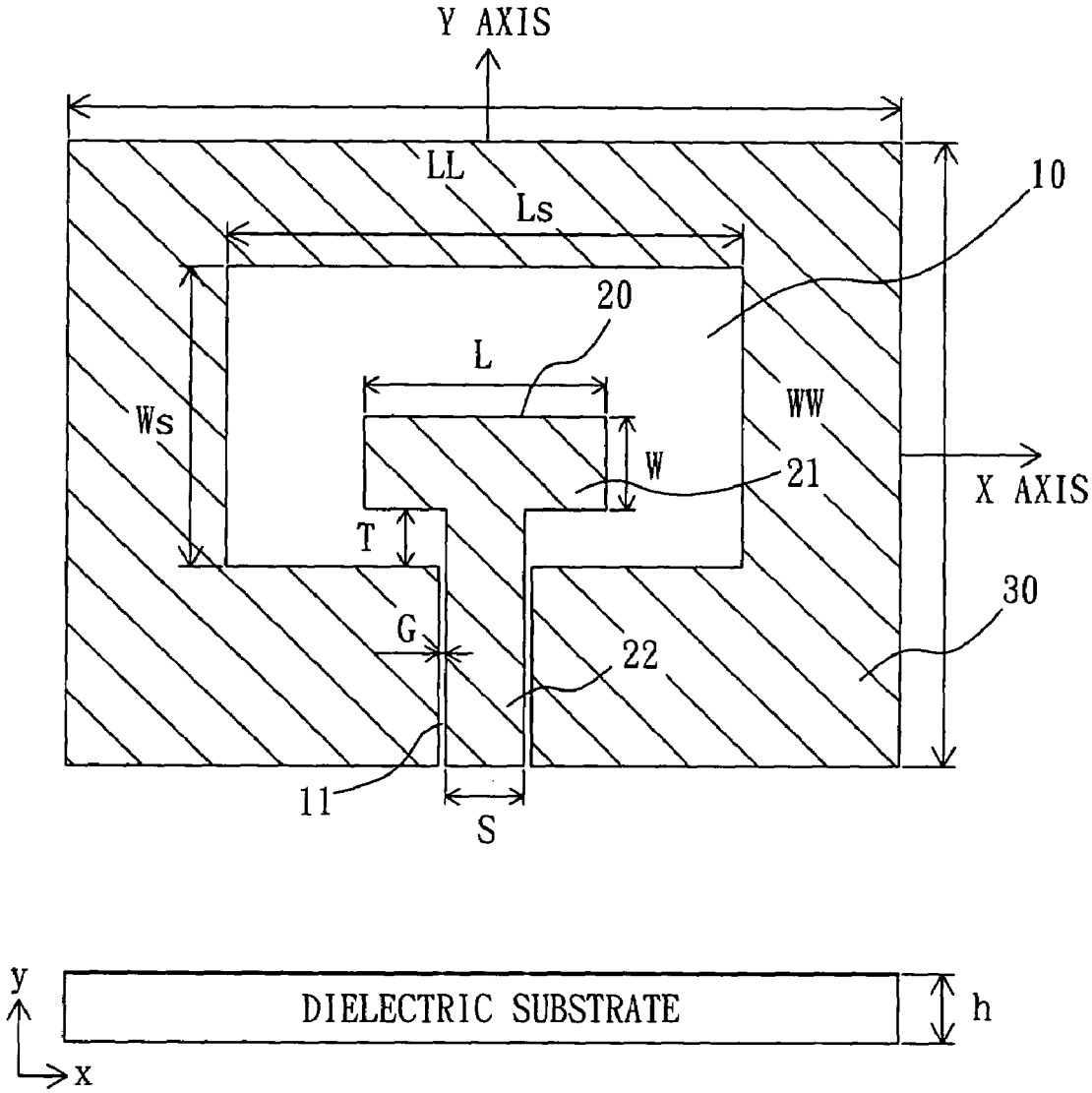
FIG. 4 schematically illustrates the configuration of a preferred embodiment of an ultra-wideband (UWB) antenna according to the present invention.
Figure 5A:
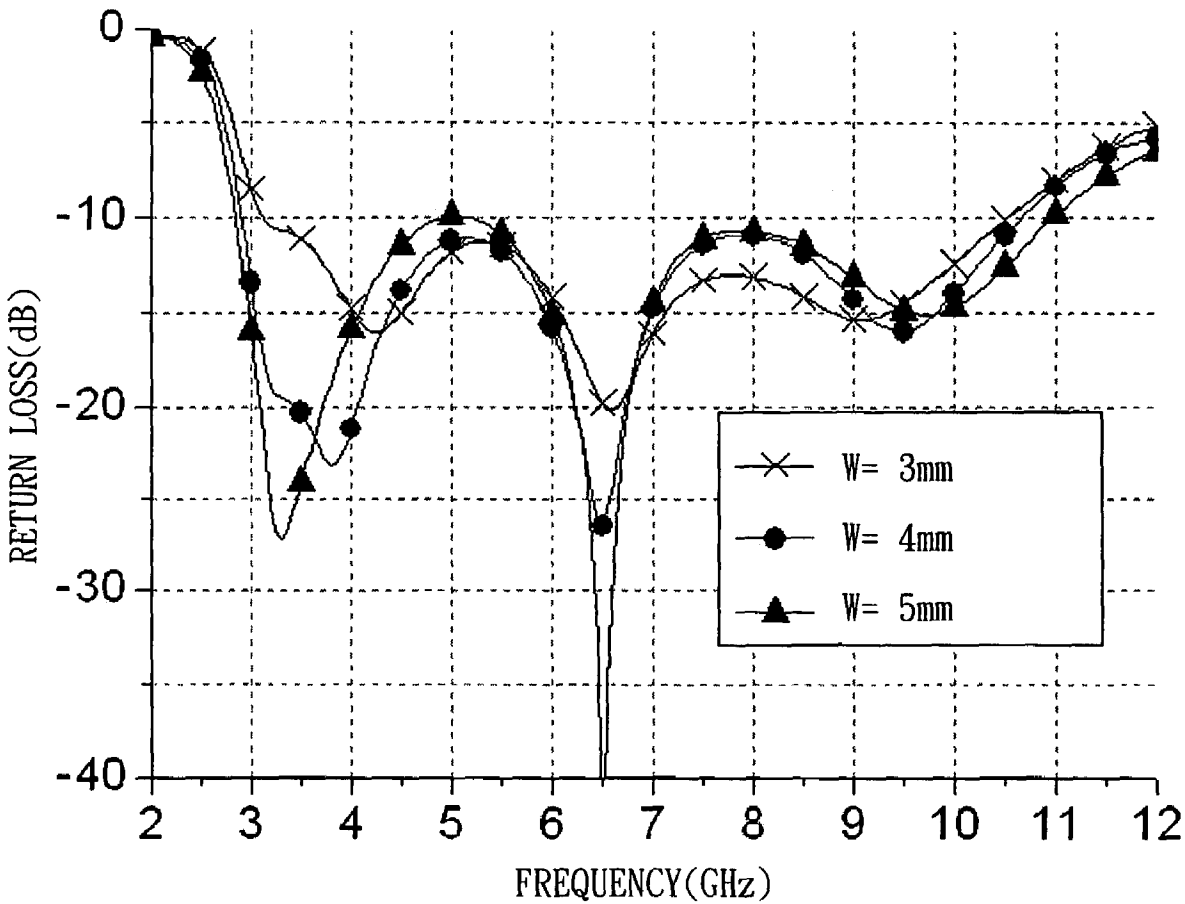
FIGS. 5(*a*)~5(*c*) schematically illustrate the return loss of an ultra-wideband (UWB) antenna according to the present invention when the length and width of the horizontal portion or the space between the lower edge of the horizontal portion and the inner circumference of the rectangular aperture portion are adjusted.
Figure 5B:
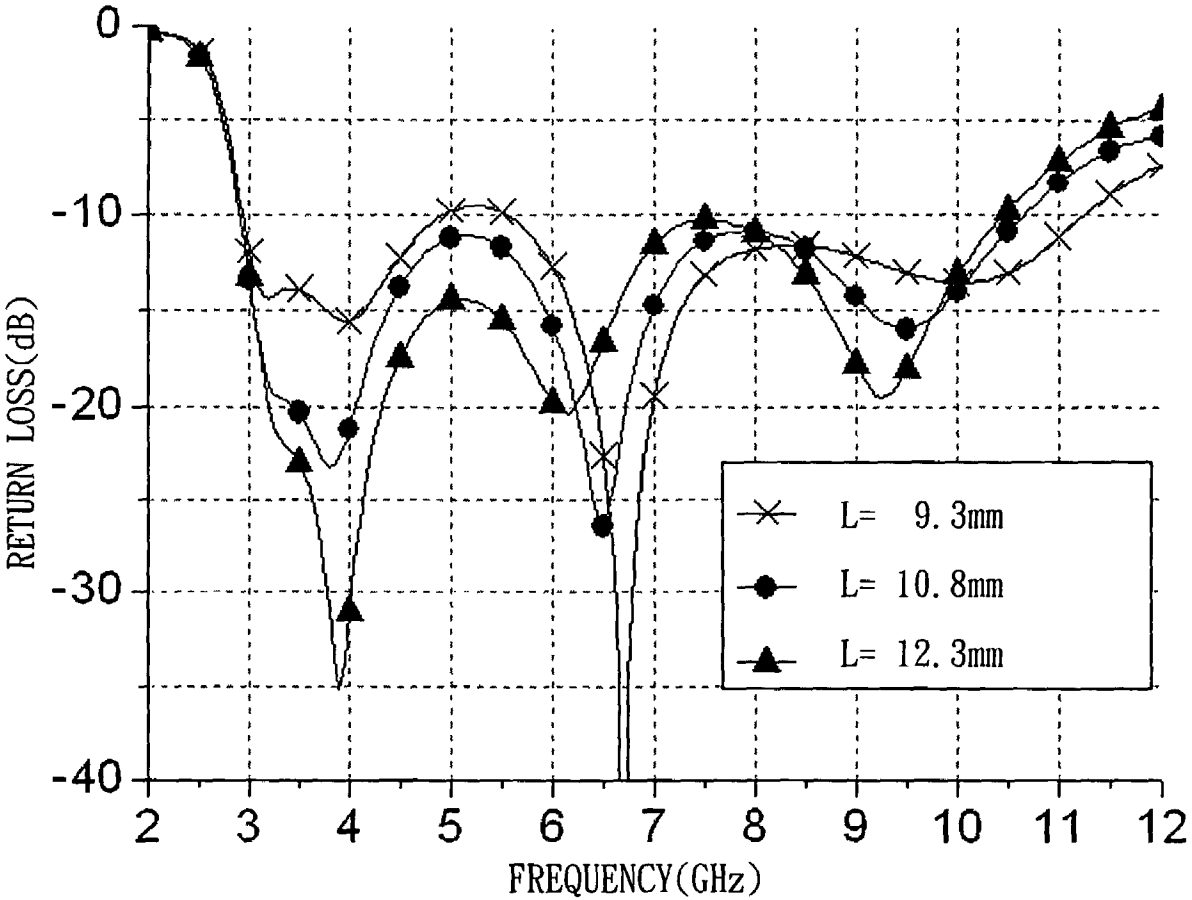
Figure 5C:
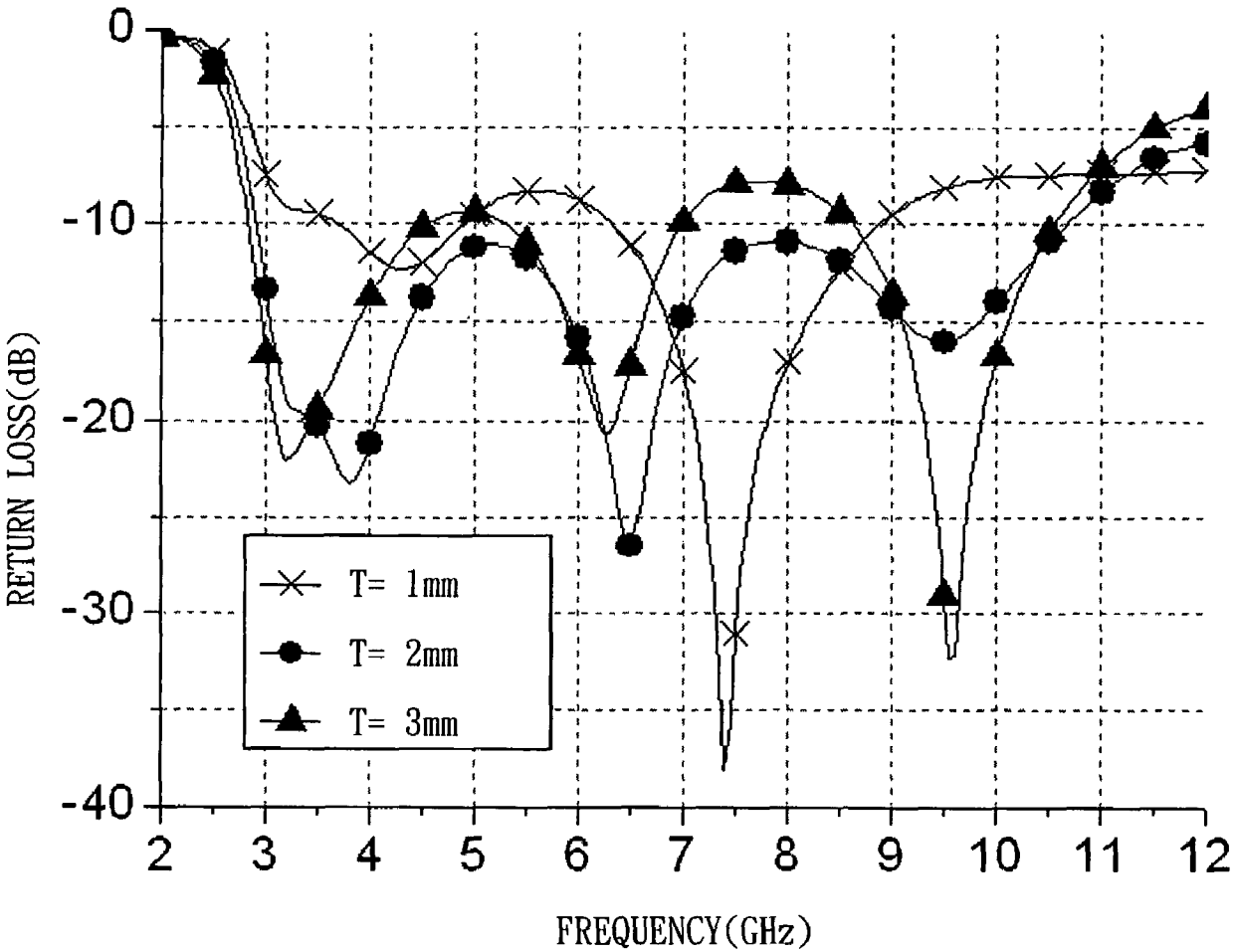
Figure 5D:
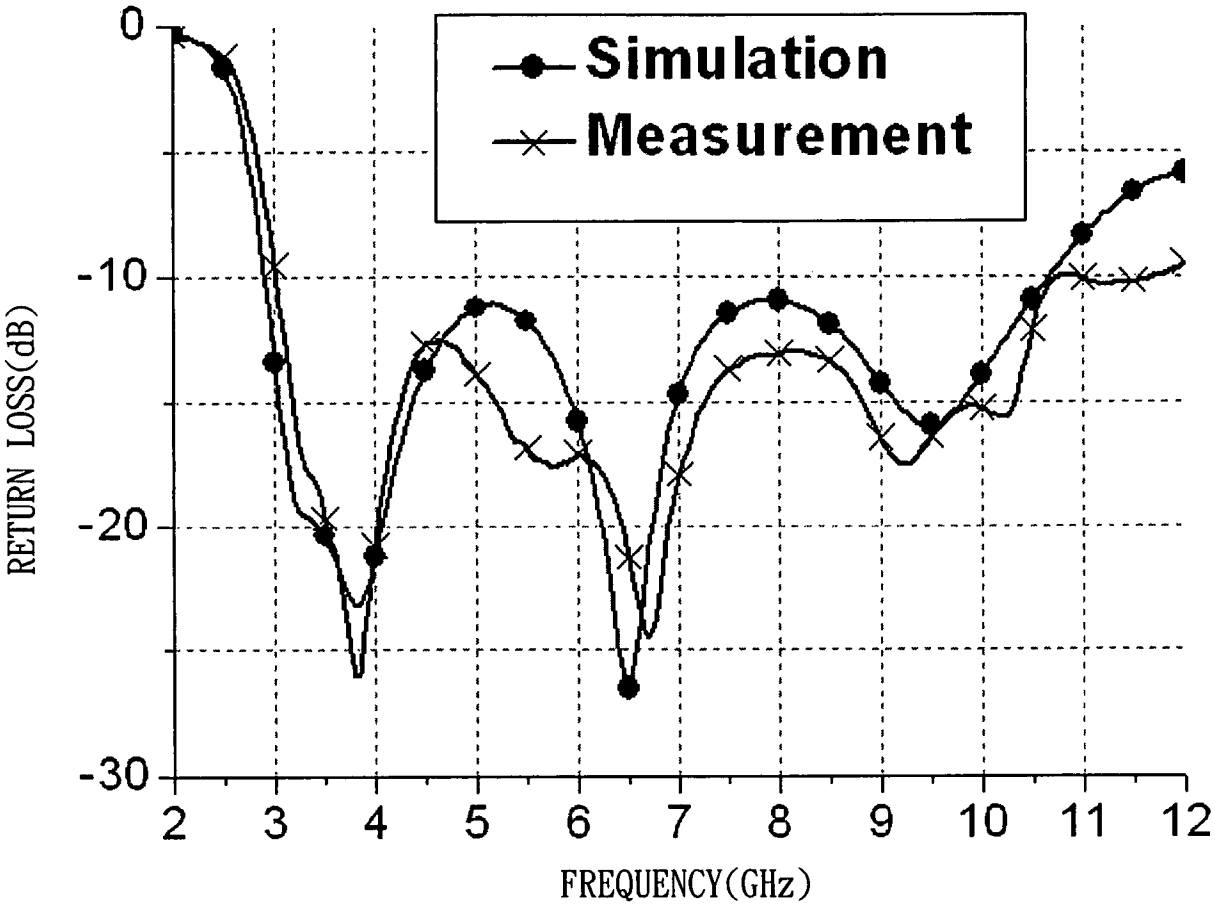

FIG. 4 schematically illustrates a preferred embodiment of an ultra-wideband (UWB) antenna according to the present invention, comprising a rectangular aperture portion 10, and a co-plane feeding structure 20.

The rectangular aperture portion 10 is formed from the ground plane of a printed circuit board 30 and has an aperture 11, wherein the printed circuit board 30 is, for example but not limited to, a single-sided PCB or bendable super-thin substrate. The present invention selects, but not limited to, a single-sided printed circuit board for purpose of explanation, so as to reduce manufacture cost.

The rectangular aperture portion 10 can be of any shape. In the present invention, the rectangular aperture portion 10 is taken as, but not limited to, a rectangular shape. The size of the rectangular aperture portion 10 is, for example but not limited to, 23 mm in length and 13 mm in width. The size of the aperture 11 is, for example but not limited to, 4.4 mm in width.

The co-plane feeding structure 20 is provided with a horizontal portion 21 and a vertical portion 22, wherein the horizontal portion 21 is perpendicular to the vertical portion 22, and the vertical portion 22 is disposed in the aperture 11 and connected with an external terminal (not shown), wherein the co-plane feeding structure 20 can be of any shape, but it should be able to match with the rectangular aperture portion 10. In the present invention, the shape of the co-plane feeding structure 20 is taken as, but not limited to, a rectangular shape for the purpose of explanation. The rectangular aperture portion 10 and the co-plane feeding structure 20 are formed by etching or carving. The co-plane feeding structure 20 can use microstrip for feeding design or any other adapter interface.

Figure 1:
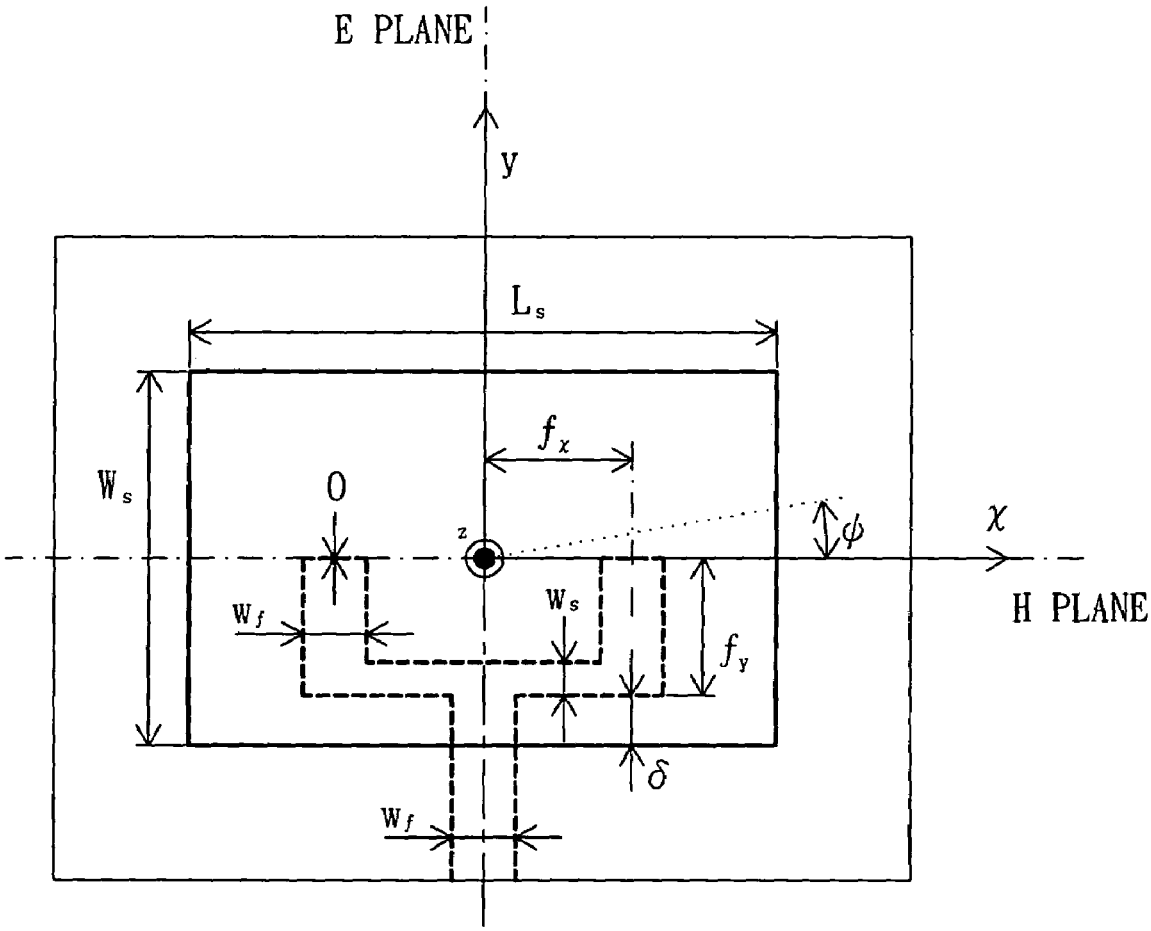
(PRIOR ART) FIG. 1
FIG. 1 schematically illustrates the configuration of a conventional ultra-wideband (UWB) antenna.
Figure 2:
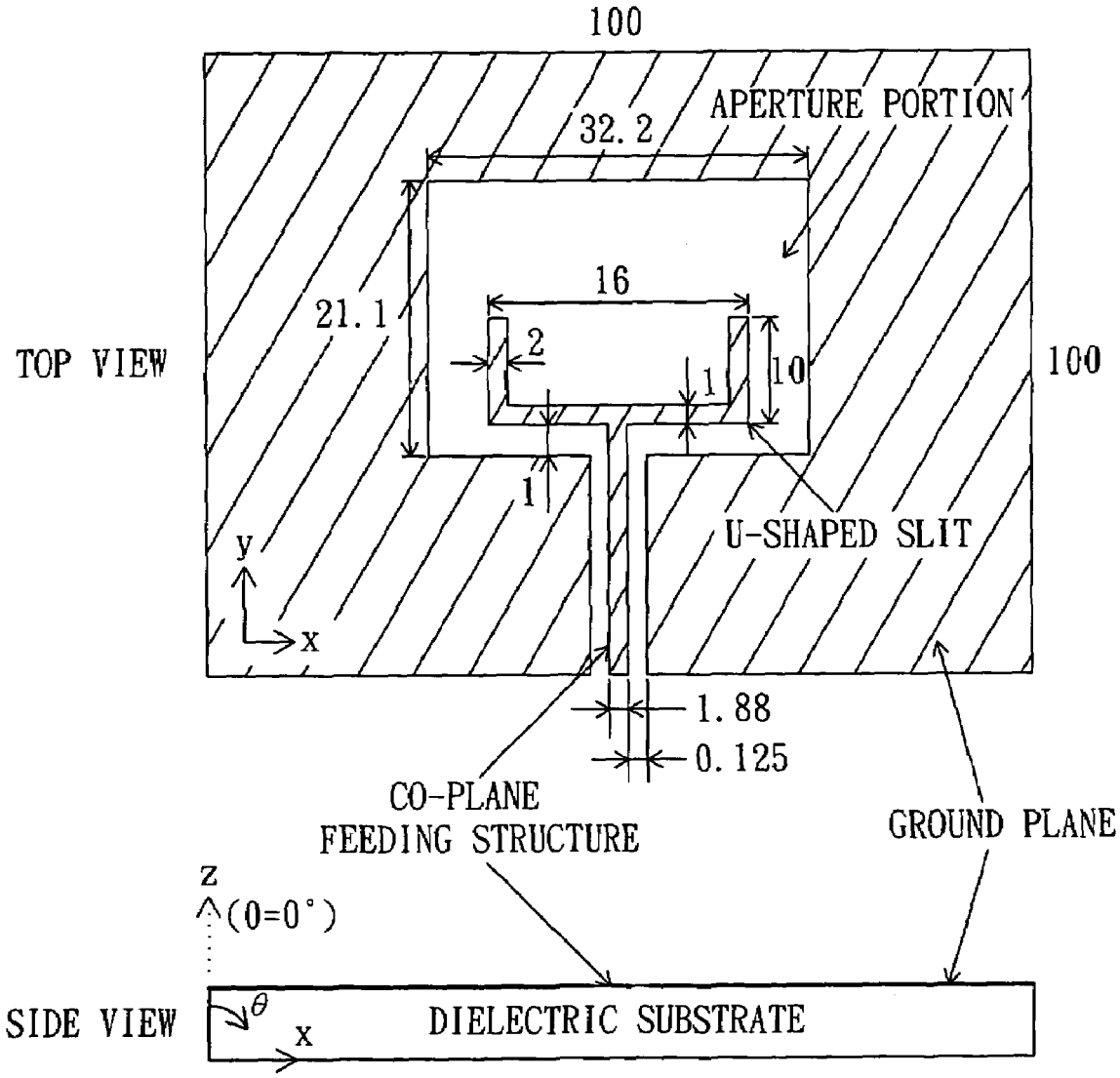
(PRIOR ART) FIG. 2
FIG. 2 schematically illustrates the configuration of another conventional ultra-wideband (UWB) antenna.
Figure 3:
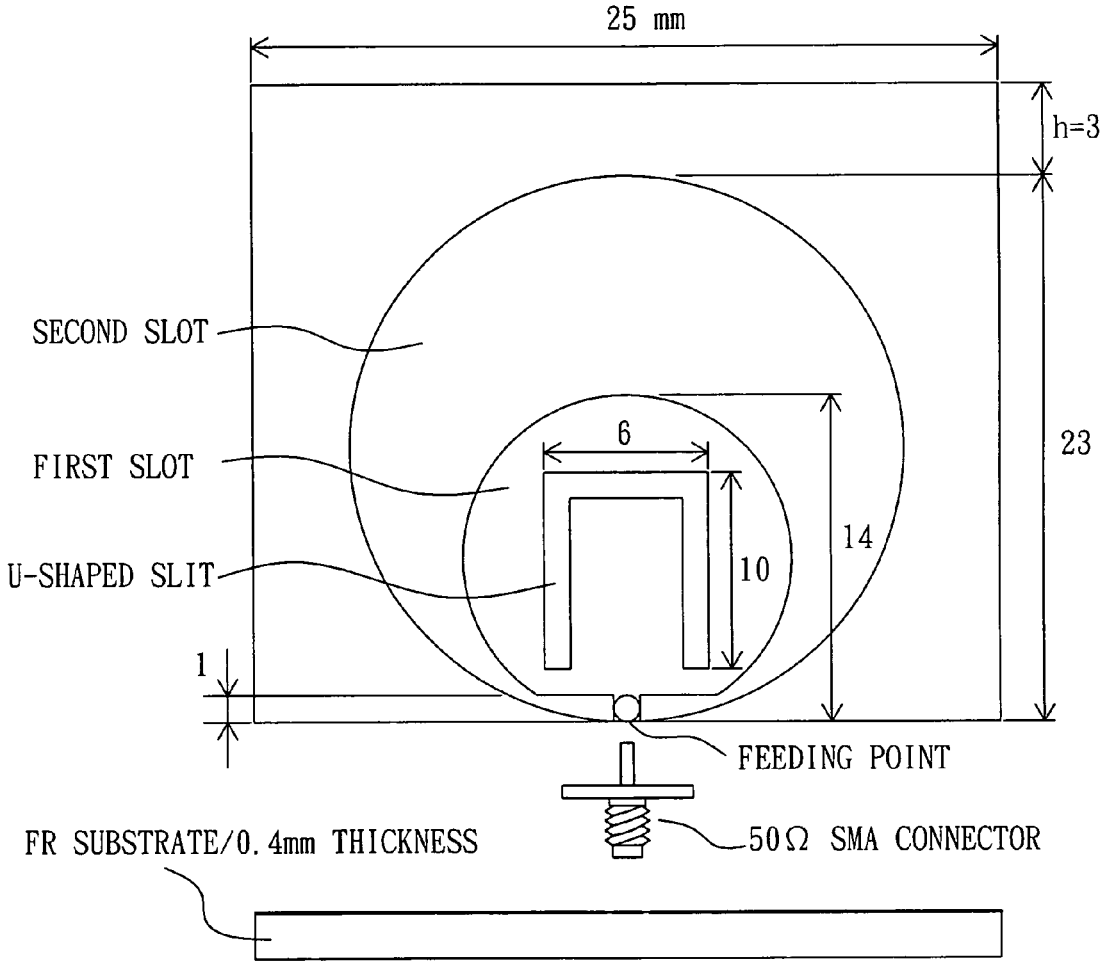
(PRIOR ART) FIG. 3
FIG. 3 schematically illustrates the configuration of still another conventional ultra-wideband (UWB) antenna.

The horizontal portion 21 is, for example but not limited to, 10.8 mm in length and 4.0 mm in width. The distance between the lower edge of the horizontal portion 21 and the lower edge of the rectangular aperture portion 10 is, for example but not limited to, 2.0 mm. The vertical portion 22 is, for example but not limited to, 3.6 mm in width and the space between both sides of the vertical portion 22 and the aperture 11 is, for example but not limited to, 0.4 mm, respectively. For the ultra-wideband (UWB) antenna according to the present invention, the size of the rectangular aperture portion 10 is only 23 mm×13 mm, which is 40% smaller than 32.2 mm×21.1 mm required in FIGS. 1 and 2, but its functions are not affected, with stable radiation pattern and excellent linearity of the signal transmitted. Consequently, the ultra-wideband (UWB) antenna according to the present invention is indeed greatly improved compared to the conventional prior art of ultra-wideband (UWB) antenna.

FIGS. 5(*a*)-5(*c*) schematically illustrate the return loss of the ultra-wideband (UWB) antenna according to the present invention when the length and width of the horizontal portion 21 or the distance between the lower edge of the horizontal portion 21 and the lower edge of the rectangular aperture portion 10 are adjusted. The parameters of the ultra-wideband (UWB) antenna according to the present invention can be adjusted by changing the length and width of the horizontal portion 21 or the distance between the lower edge of the horizontal portion 21 and the lower edge of the rectangular aperture portion 10. As shown in FIG. 5(*a*), the rectangular aperture portion 10 is 23 mm in length and 13 mm in width; the vertical portion 22 is 3.6 mm in width and the distance between its both sides and the aperture 11 is 0.4 mm, respectively. The horizontal portion 21 is 10.8 mm in length and its width (W) are adjustable and when the distance between the lower edge of the horizontal portion 21 and the lower edge of the rectangular aperture portion 10 is 2.0 mm. The width (W) of the horizontal portion 21 affects mainly the impedance of lower frequencies (3-4 GHz).

As shown in FIG. 5(*b*), the rectangular aperture portion 10 is 23 mm in length and 13 mm in width. The vertical portion 22 is 3.6 mm in width and the space between its both sides and the aperture 11 is 0.4 mm, respectively. The horizontal portion 21 is 4.0 mm in width and its length (L) is adjustable and when the distance between the lower edge of the horizontal portion 21 and the lower edge of the rectangular aperture portion 10 is 2.0 mm, the length (L) of the horizontal portion 21 affects mainly the impedance of both low and middle bands (4-7 GHz).

As shown in FIG. 5(*c*), the rectangular aperture portion 10 is 23 mm in length and 13 mm in width. The vertical portion 22 is 3.6 mm in width and the space between its both sides and the aperture 11 is 0.4 mm, respectively. The horizontal portion 21 is 10.8 mm in length and 4.0 mm in width and when the distance (T) between the lower edge of the horizontal portion 21 and the lower edge of the rectangular aperture portion 10 are adjustable, the distance (T) between the lower edge of the horizontal portion 21 and the lower edge of the rectangular aperture portion 10 is relatively sensitive to the input impedance of the entire band (3.1-10.6 GHz).

FIG. 5(*d*) schematically illustrates the simulated and measured return loss of the ultra-wideband (UWB) antenna according to the present invention. As shown in the figure, the rectangular aperture portion 10 is 23 mm in length and 13 mm in width. The vertical portion 22 is 3.6 mm in width and the space between its both sides and the aperture 11 is 0.4 mm, respectively. The horizontal portion 21 is 10.8 mm in length and 4.0 mm in width and when the distance (T) between the lower edge of the horizontal portion 21 and the lower edge of the rectangular aperture portion 10 is 2.0 mm, there are three resonances around the frequencies at 4, 7, and 10 GHz, for both the simulated and measured return loss obtained by a simulation program and measured by a spectrum analyzer, respectively. These resonances correspond to the different modes of field distribution and play important roles on the explanation of the radiation patterns. The strong correlation between the simulated and measured results shows that the ultra-wideband (UWB) antenna according to the present invention can indeed greatly reduce the area of the printed circuit board without affecting its functions.

Figure 6:
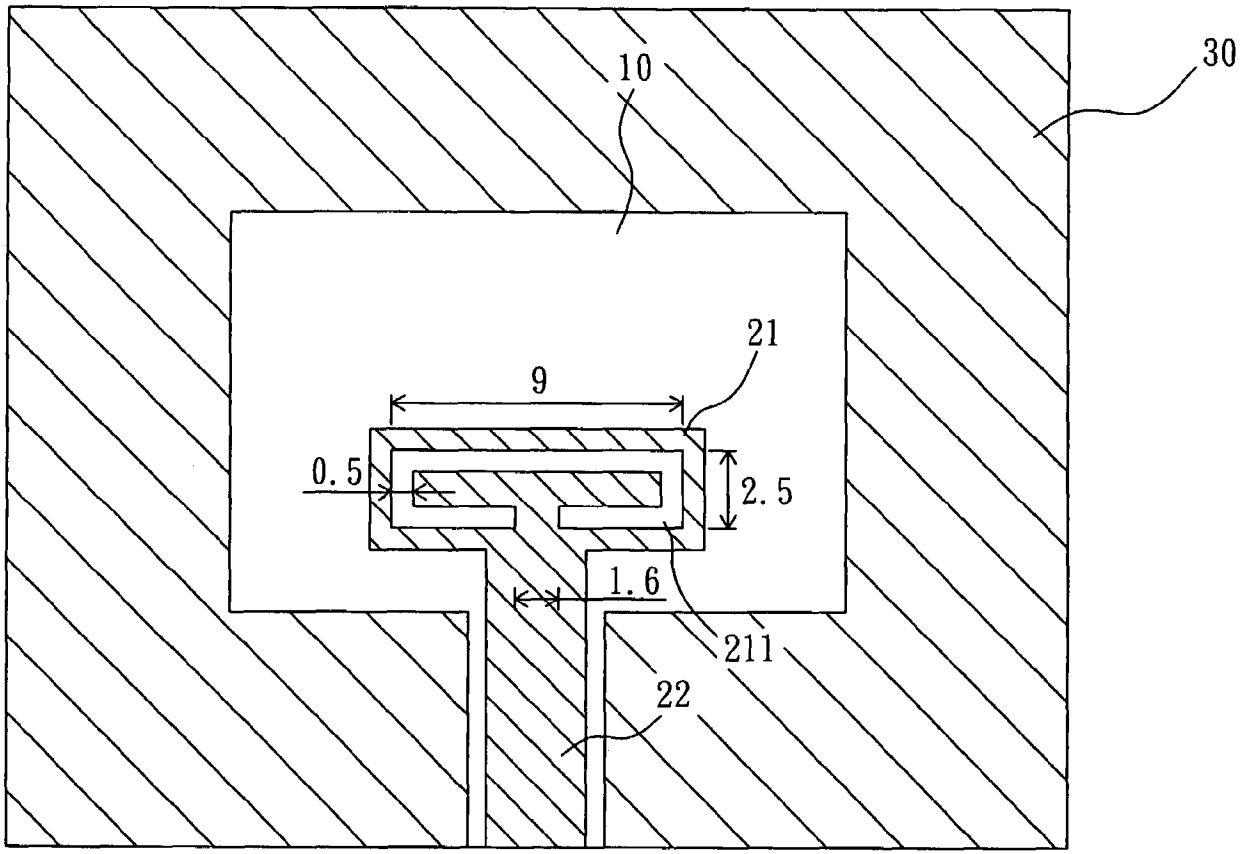
FIG. 6 schematically illustrates the configuration of another preferred embodiment of an ultra-wideband (UWB) antenna according to the present invention.

FIG. 6 schematically illustrates another preferred embodiment of the ultra-wideband (JWB) antenna according to the present invention. As shown in the figure, the horizontal portion 21 of the ultra-wideband (UWB) antenna according to the present invention is further cut to form an isolated slit 211. The isolated slit 211 is used as a parasitic element so as to render the ultra-wideband (UWB) antenna unable to transmit and receive in the 5-6 GHz band, wherein the isolated slit 211 is formed by removing the conducting material of the horizontal portion 21 to form a slit whose both ends do not meet.

Figure 7:
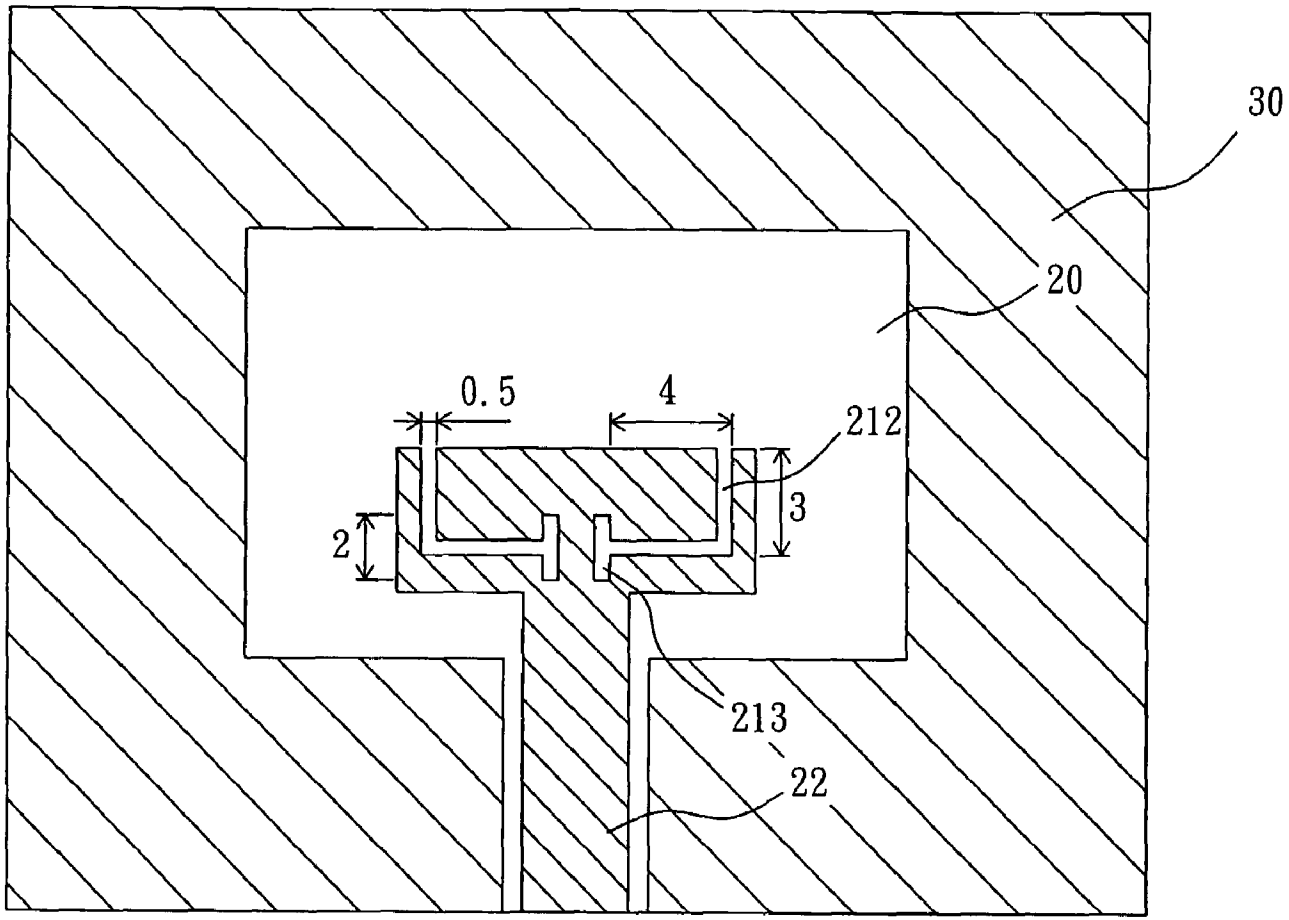
FIG. 7 schematically illustrates the configuration of yet another preferred embodiment of an ultra-wideband (UWB) antenna according to the present invention.

FIG. 7 schematically illustrates yet another preferred embodiment of the ultra-wideband (UWB) antenna according to the present invention. As shown in the figure, the horizontal portion 21 of the ultra-wideband (UWB) antenna according to the present invention is further cut to form an open slit 212. The open slit 212 is used as a parasitic element so as to render the ultra-wideband (UWB) antenna unable to transmit and receive in the 5-6 GHz band, wherein the open slit 212 is formed by removing the conducting material of the horizontal portion 21 to form a L-shaped slit and its end of the horizontal segment is provided with a vertical segment 213. Furthermore, there are two open slits 212, which are symmetrically disposed.

Figure 8:
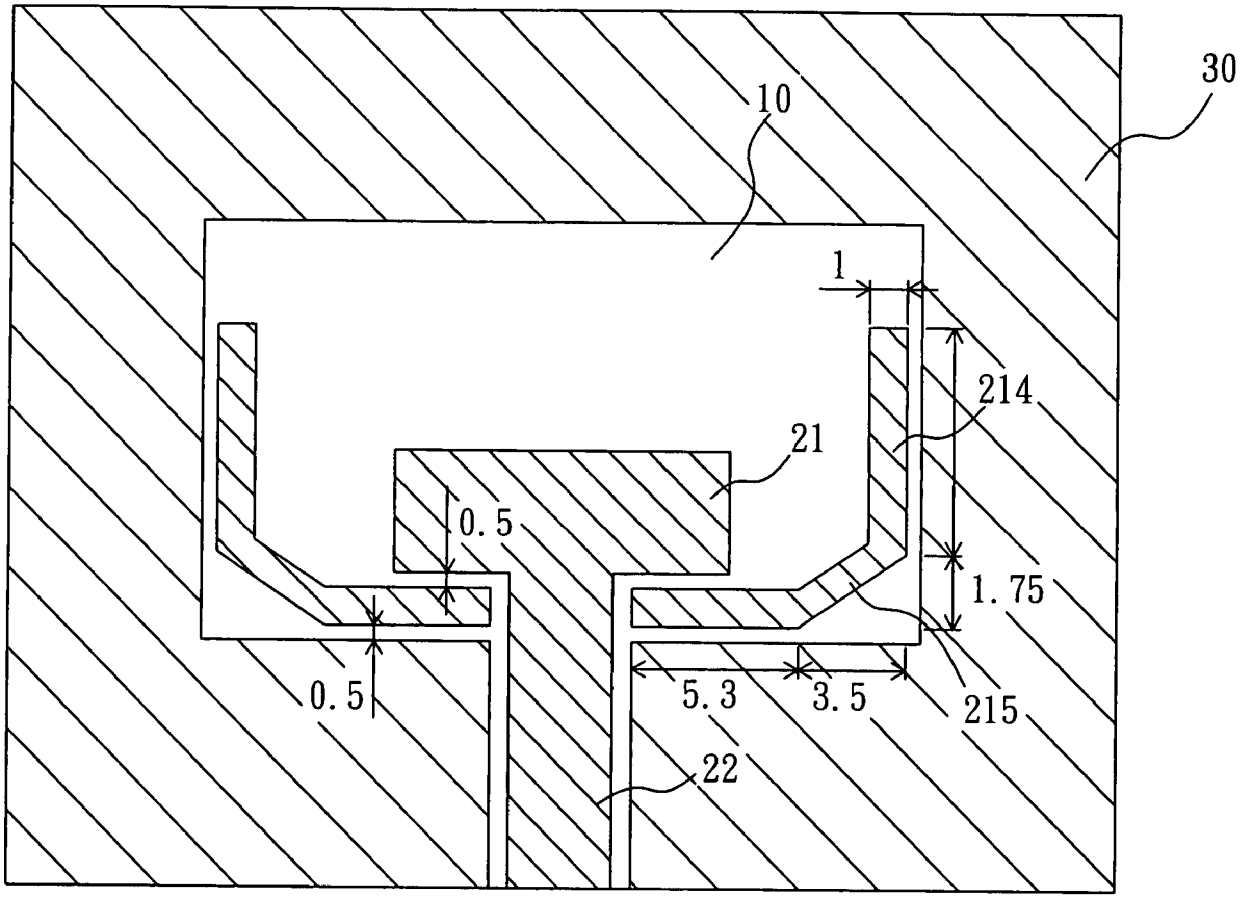
FIG. 8 schematically illustrates the configuration of still another preferred embodiment of an ultra-wideband (UWB) antenna according to the present invention.

FIG. 8 schematically illustrates still another preferred embodiment of the ultra-wideband (UWB) antenna according to the present invention. As shown in the figure, the lower edge of the horizontal portion 21 of the ultra-wideband (UWB) antenna according to the present invention is further cut to form a parasitic strip 214. The parasitic strip 214 is used as a parasitic element so as to render the ultra-wideband (UWB) antenna unable to transmit and receive in the 5-6 GHz band, wherein the parasitic strip 214 is long and narrow with a bend 215. Furthermore, there are two parasitic strips 214, which are symmetrically disposed.

Figure 9:
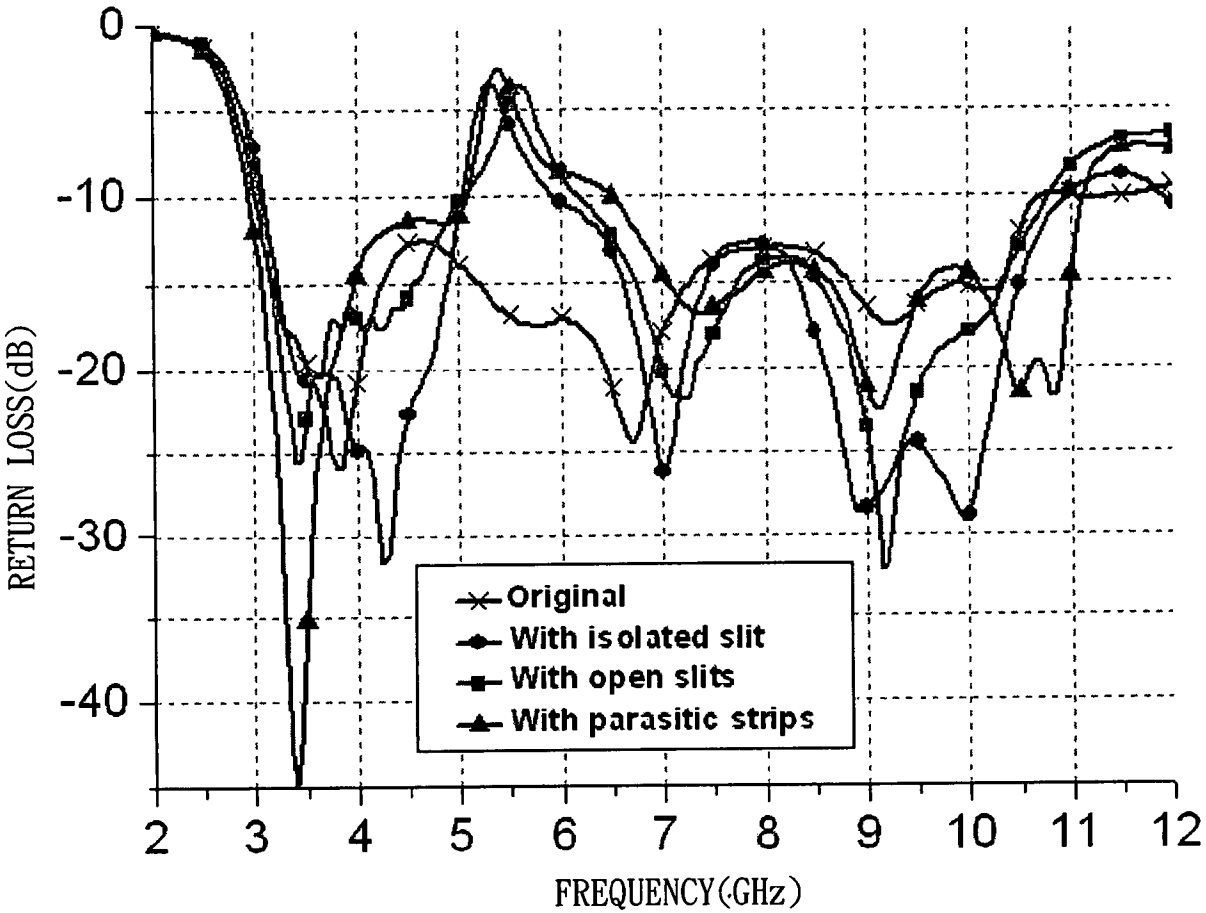
FIG. 9 schematically illustrates the simulated and measured return loss of the ultra-wideband (UWB) antenna shown in FIGS. 4, 6, 7, and 8, respectively, according to the present invention.

FIG. 9 schematically illustrates the simulated and measured return loss of the ultra-wideband (UWB) antenna shown in FIGS. 4, 6, 7, and 8, respectively, according to the present invention. As shown in FIG. 9, the ultra-wideband (UWB) antenna shown in FIG. 4 according to the present invention has lower return loss in the 5-6 GHz band, and thus is capable of transmitting and receiving in the 5-6 GHz band. On the other hand, the ultra-wideband (UWB) antenna shown in FIGS. 6, 7, and, 8, respectively, has higher return loss and thus incapable of transmitting and receiving in the 5-6 GHz band and thus can reject the signals of IEEE 802.11a (5-6 GHz).

Consequently, by putting the ultra-wideband (UWB) antenna according to the present invention in practice, the ultra-wideband (UWB) antenna can provide the following advantages: it can greatly reduce the area of the printed circuit board but do not affect its performance; it can be easily extended to an antenna with the band-rejection function, but the original design of the antenna needs not to be changed; and its co-plane feeding structure is simple in geometry and the parameters of the ultra-wideband (UWB) antenna can be adjusted by adjusting the length and width of the horizontal portion or the space between the lower edge of the horizontal portion of the co-plane feeding structure and the inner circumference of the rectangular aperture portion. Therefore, the ultra-wideband (UWB) antenna according to present invention can indeed overcome the shortcomings of the conventional prior art of the ultra-wideband (UWB) antenna.

While the invention has been described with reference to a preferred embodiment thereof, it is to be understood that modifications or variations may be easily made without departing from the spirit of this invention, which is defined by the appended claims.

What is claimed is:

1. An ultra-wideband (UWB) antenna comprising:

a rectangular aperture portion formed from a ground plane of a printed circuit board and having an aperture;

a co-plane feeding structure having a horizontal portion and a vertical portion;

the horizontal portion comprising a conductive material;

wherein the vertical portion is perpendicular to the horizontal portion, and the vertical portion is disposed in the aperture and connected with an external terminal;

wherein the horizontal portion has an open L-shaped slit having a horizontal segment and a vertical segment, the horizontal portion further having a closed end vertical slit, the closed end vertical slit being disposed at a closed end of the horizontal segment, the L-shaped slit and the closed end vertical slit being defined by removed conductive material from the horizontal portion.

2. The ultra-wideband (UWB) antenna according to claim 1, wherein the printed circuit board is a bendable super-thin substrate.

3. The ultra-wideband (WB) antenna according to claim 1, wherein the size of the rectangular aperture portion is 23 mm in length and 13 mm in width and the size of the aperture is 4.4 mm in width.

4. The ultra-wideband (UWB) antenna according to claim 1, wherein the vertical portion is 3.6 mm in width and the distance between both sides of the vertical portion and the aperture is 0.4 mm, respectively, and the horizontal portion is 10.8 mm in length and 4.0 mm in width and the distance between the lower edge of the horizontal portion and the lower edge of the rectangular aperture portion is 2.0 mm.

5. The ultra-wideband (UWB) antenna according to claim 4, wherein the length and width of the horizontal portion and the distance between the lower edge of the horizontal portion of the co-plane feeding structure and the lower edge of the rectangular aperture portion can be adjusted to change the parameters of the ultra-wideband (UWB) antenna.

6. The ultra-wideband (UWB) antenna according to claim 1, wherein the rectangular aperture portion and the L-shaped slit and the closed end vertical slit of the co-plane feeding structure are each respectively etched.

7. The ultra-wideband (UWB) antenna according to claim 1, wherein the co-plane feeding structure can use a microstrip for feeding design.

8. The ultra-wideband (UWB) antenna according to claim 1, wherein there are two open L-shaped slits which are symmetrically disposed.

9. An ultra-wideband (UWB) antenna comprising:

a rectangular aperture portion formed from a ground plane of a printed circuit board and having an aperture;

a co-plane feeding structure having a horizontal portion and a vertical portion;

the vertical portion is perpendicular to the horizontal portion, and the vertical portion is disposed in the aperture and connected with an external terminal;

the horizontal portion having a lower edge which is further cut to form a parasitic strip which is used as a parasitic element; and wherein the parasitic strip is long and narrow with a bend.

10. The ultra-wideband (UWB) antenna according to claim 9, wherein there are two parasitic strips which are symmetrically disposed.

11. The ultra-wideband (UWB) antenna according to claim 9, wherein the printed circuit board is a bendable super-thin substrate.

12. The ultra-wideband (UWB) antenna according to claim 9, wherein the size of the rectangular aperture portion is 23 mm in length and 13 mm in width and the size of the aperture is 4.4 mm in width.

13. The ultra-wideband (UWB) antenna according to claim 9, wherein the length and width of the horizontal portion and the distance between the lower edge of the horizontal portion of the co-plane feeding structure and the lower edge of the rectangular aperture portion can be adjusted to change the parameters of the ultra-wideband (UWB) antenna.

14. The ultra-wideband (UWB) antenna according to claim 9, wherein the rectangular aperture portion and the co-plane feeding structure are each respectively etched.

15. The ultra-wideband (UWB) antenna according to claim 9, wherein the co-plane feeding structure can use a microstrip for feeding design.

* * * * *